US005187824A

United States Patent [19]

Stryker

[11] Patent Number: 5,187,824

[45] Date of Patent: Feb. 23, 1993

[54] ZERO CLEARANCE SUPPORT MECHANISM FOR HOSPITAL BED SIDERAIL, IV POLE HOLDER, AND THE LIKE

[75] Inventor: Martin W. Stryker, Kalamazoo, Mich.

[73] Assignee: Stryker Corporation, Kalamazoo, Mich.

[21] Appl. No.: 877,545

[22] Filed: May 1, 1992

[51] Int. Cl.[5] ..... A47C 21/08; A47C 21/00; A61G 7/00

[52] U.S. Cl. ..... 5/430; 5/600; 5/503.1; 5/658; 5/662

[58] Field of Search ..... 5/430, 429, 428, 425, 5/100, 600, 621, 624, 503.1, 507.1, 658, 662, 649

[56] References Cited

U.S. PATENT DOCUMENTS

| | | | |
|---|---|---|---|
| 2,284,470 | 5/1942 | Comper et al. . | |
| 2,585,660 | 2/1952 | Kjos et al. | 5/662 |
| 2,786,214 | 3/1957 | Armstrong . | |
| 3,081,463 | 3/1963 | Williams et al. . | |
| 3,286,283 | 11/1966 | Bertoldo | 5/662 |
| 3,318,596 | 5/1967 | Herzog | 5/611 |
| 3,585,659 | 6/1971 | Burst et al. . | |
| 3,585,660 | 6/1971 | Gottfried et al. | 5/430 |
| 3,839,753 | 10/1974 | Benoit et al. . | |
| 3,855,654 | 12/1974 | Pivacek | 5/100 |
| 3,930,273 | 1/1976 | Stern | 5/100 |
| 3,932,903 | 1/1976 | Adams et al. | 5/100 |
| 3,958,283 | 5/1976 | Adams et al. . | |
| 4,002,330 | 1/1977 | Johannsson . | |
| 4,206,525 | 6/1980 | Williams | 5/430 |
| 4,221,370 | 9/1980 | Redwine . | |
| 4,426,071 | 1/1984 | Klevstad | 5/613 |
| 4,486,908 | 12/1984 | Schroeder | 5/430 |
| 4,509,217 | 4/1985 | Therrien | 5/430 |
| 4,541,622 | 9/1985 | Tabuchi | 5/621 |
| 4,653,129 | 3/1987 | Kuck et al. | 5/430 |
| 4,669,136 | 6/1987 | Waters et al. . | |
| 4,703,975 | 11/1987 | Roberts et al. . | |
| 4,715,592 | 12/1987 | Lewis | 5/632 |
| 4,747,171 | 5/1988 | Einsele et al. | 5/430 |
| 4,839,933 | 6/1989 | Plewright et al. | 5/430 |
| 4,858,260 | 8/1989 | Failor et al. | 5/430 |
| 4,949,410 | 8/1990 | Failor et al. | 5/430 |
| 4,985,946 | 1/1991 | Foster et al. | 5/430 |
| 5,060,327 | 10/1991 | Celestina et al. | 5/662 |

FOREIGN PATENT DOCUMENTS

| | | | |
|---|---|---|---|
| 189576 | 12/1922 | United Kingdom | 5/185 |

OTHER PUBLICATIONS

Techlem T-1000 Trans-Porter brochure, 2 pages Techlem Medical Systems 6890 Pacific Circle, Mississauga, Ontario, Canada.

*Primary Examiner*—Alexander Grosz

*Attorney, Agent, or Firm*—Flynn, Thiel, Boutell & Tanis

[57] ABSTRACT

A hospital bed has a horizontally extending edge portion on a frame, the frame supporting a mattress with an upwardly facing patient support surface. A collapsible side rail has an elongate top rail and a plurality of arms each supported at one end on the frame for pivotal movement about a first pivot axis and supported at the opposite end on the elongated member for pivotal movement about a second pivot axis parallel to the first pivot axis, the first and second pivot axes each extending at an acute angle with respect to each of a horizontal reference plane, a vertical reference plane perpendicular to the edge portion, and a vertical reference plane parallel to the edge portion. In a retracted position, the entire side rail is disposed lower than and laterally inwardly of the edge portion. In a variation, a member such as an IV pole is supported on the bed frame for pivotal movement about a pivot axis which extends at an acute angle to each of the three reference planes.

25 Claims, 3 Drawing Sheets

ZERO CLEARANCE SUPPORT MECHANISM FOR HOSPITAL BED SIDERAIL, IV POLE HOLDER, AND THE LIKE

FIELD OF THE INVENTION

The present invention relates to a collapsible side rail for a hospital bed and, more particularly, to such a side rail which, in its retracted position, is completely laterally inwardly of a side edge portion of the bed so that the side edge can be placed directly adjacent the side edge of another bed without side rail interference in order to facilitate a patient transfer.

BACKGROUND OF THE INVENTION

Hospital beds have traditionally had some type of collapsible side rail on each side of the mattress, so that a patient on the bed cannot inadvertently roll off of the bed and receive serious injuries from a fall to the floor. One conventional type of collapsible side rail includes a plurality of arms which are each supported at one end on a frame of the bed for pivotal movement about a horizontal first pivot axis extending transversely of the bed, and which each have an opposite end supported on a horizontally extending top rail for pivotal movement about a horizontal second axis parallel to the first. The arms are pivotal between an operational position in which the arms are upright and the top rail is disposed above the mattress surface, and a retracted position in which the arms extend approximately horizontally and the top rail is disposed below the top of the mattress. When this conventional side rail is in the collapsed or retracted position, it is still disposed laterally outwardly of the mattress. Consequently, when two beds are placed immediately adjacent each other to facilitate the transfer of a patient from one bed to another, the side rails of each bed serve to keep the mattresses spaced somewhat from each other, and thus hospital personnel must manually lift a patient across the relatively large gap between the mattresses.

As a result of this problem, there have been efforts in recent years to develop a side rail which, in the retracted position, is below and laterally inwardly of an edge portion of the bed, so that when two beds are placed together for purposes of patient transfer the side rails are not between and do not cause a forced spacing of the edge portions, but instead the edge portions can be placed directly against each other. One known approach is to provide additional arms which extend horizontally between and are pivotally coupled by vertical pivot axes to a stationary bed frame and a support member, the arms of the side rail itself being pivotally supported on the laterally movable support member. This known arrangement is, however, complex in structure and therefore expensive to manufacture and cumbersome to use.

An alternative known approach is to provide two transversely extending slide rods on the bed frame and to slidably support a subframe on these members for lateral movement relative to the bed, the arms of the side rail being pivotally supported on the laterally movable subframe. Again, however, the resulting arrangement is structurally complex, and therefore expensive to manufacture and cumbersome to use. Further, if either end of the subframe is moved laterally a little faster than the other end, the subframe can frictionally bind with respect to the transversely extending slide rods, and dependable lateral movement is thus difficult to achieve.

An object of the present invention is therefore to provide an improved arrangement for supporting a side rail for movement between operational and retracted positions in a manner so that the side rail moves downwardly and inwardly as it moves into its retracted positions, which mechanism is structurally simple and is therefore inexpensive to manufacture and easy to operate.

A further object is to provide such an arrangement which can also be satisfactorily used to support other components on a bed, such as an IV pole, a foot support stirrup, leg support, hand grip, or push handle.

SUMMARY OF THE INVENTION

The objects and purposes of the invention, including those set forth above, are met according to one form of the present invention by providing a patient support apparatus having an upwardly facing patient support surface and having an approximately horizontally extending edge portion, an arm having first and second ends, an arrangement cooperable with the first end of the arm for supporting the arm for pivotal movement with respect to the edge portion about a pivot axis oriented at an acute angle with respect to a horizontal reference plane, the second end of the arm being spaced radially from the pivot axis, and a member supported on the arm at the second end thereof, the arm being pivotal between operational and retracted positions in which the member is respectively higher than and lower than the patient support surface.

According to a different form of the present invention, a hospital bed has a stationary frame, an upwardly facing patient support surface, and a side rail supported on the frame for movement between raised and retracted positions, the side rail including a horizontally extending top rail and a plurality of elongate arms which each have a first end supported on the frame for pivotal movement about a respective first axis and having a second end supported on the top rail for pivotal movement about a respective second axis, the first and second axes all being parallel to each other, and each of the first and second axes extending at an acute angle with respect to a horizontal reference plane.

According to yet another form of the present invention, a hospital bed includes a stationary frame, an upwardly facing patient support surface, and a side rail supported on the frame for movement between operational and retracted positions, the side rail including an elongate top rail and a plurality of arms which each have a first end supported on the frame for pivotal movement about a respective first pivot axis and a second end supported on the top rail for pivotal movement about a respective second pivot axis, the first and second pivot axes all being parallel to each other, and the top rail extending at an acute angle with respect to a reference plane which is perpendicular to the first and second pivot axes.

According to still another form of the invention, a patient support apparatus includes an upwardly facing patient support surface, an approximately horizontally extending edge portion, an arm having first and second ends, an arrangement cooperable with the first end of the arm for supporting the arm for pivotal movement with respect to the edge portion about a pivot axis oriented at an acute angle with respect to a horizontal reference plane, and extending at an angle to a vertical reference plane which is perpendicular to the edge portion, the second end of the arm being spaced radially from the pivot axis, and a member being supported on the arm at the second end thereof.

BRIEF DESCRIPTION OF THE DRAWINGS

Preferred embodiments of the invention are described in detail hereinafter with reference to the accompanying drawings, in which.

DETAILED DESCRIPTION

Figure 1:
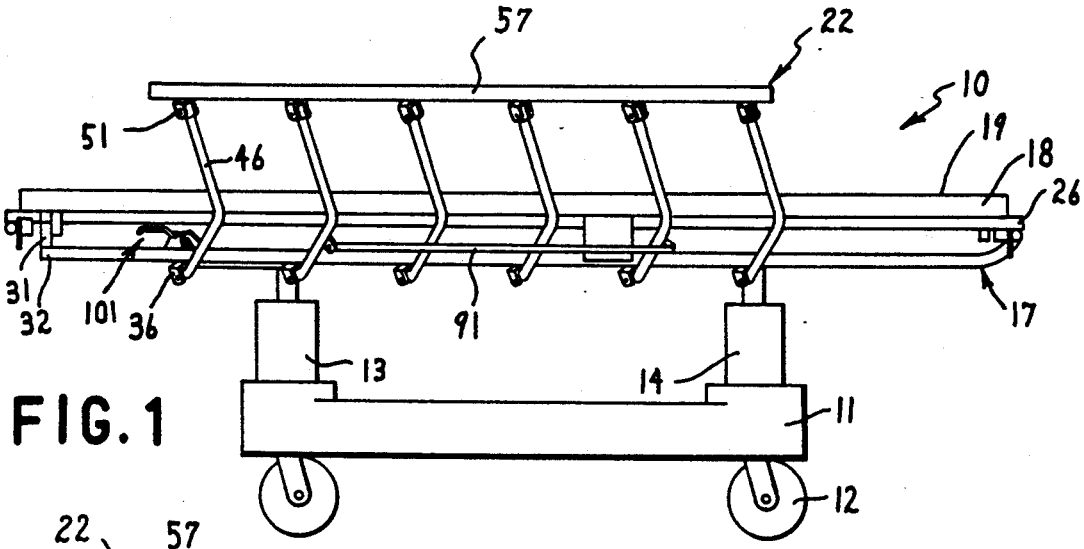
FIG. 1 is a side view of a hospital bed having a collapsible side rail which embodies the present invention.

Referring to FIG. 1, reference numeral 10 designates a mobile hospital bed or stretcher which embodies the present invention. The bed 10 includes a base 11 which is movably supported by a plurality of casters 12, and which has thereon two upright pedestals 13 and 14 supporting a frame 17. In the preferred embodiment, the pedestals 13 and 14 are each a hydraulic cylinder which, in a conventional manner, effect adjustment of the vertical height of the frame 17 relative to the base 11. The frame 17 supports a mattress 18 having a horizontal, upwardly facing patient support surface 19. The frame 17 also supports a collapsible side rail 22, which is movable between a raised operational position shown in FIG. 1 and a lowered or retracted position shown in FIG. 2. The bed 10 has a side rail 22 on each side thereof, but the side rails 22 are mirror images of each other, and therefore only one is shown and described in detail.

Figure 4:
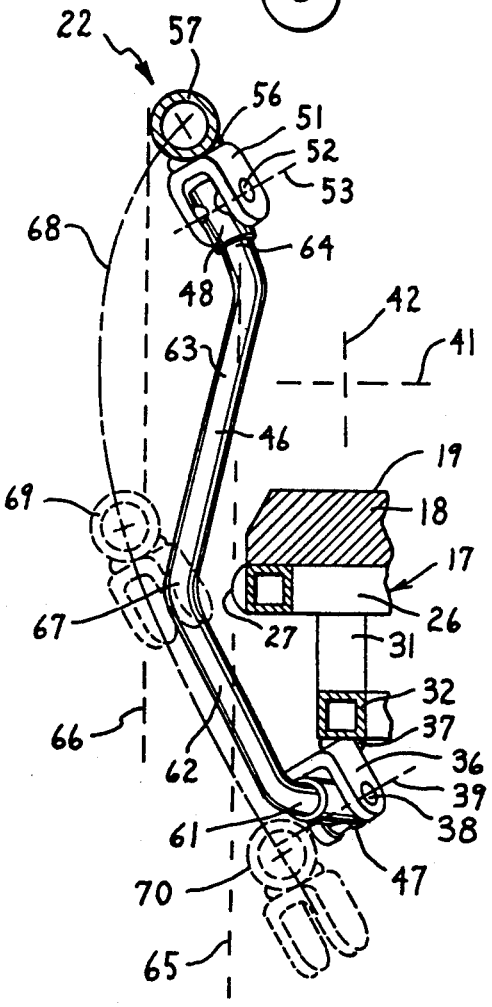
FIG. 4 is a fragmentary sectional end view of the structure of FIG. 3.

As best shown in FIG. 4, the frame 17 includes a rectangular, horizontally extending mattress support portion 26 which supports the mattress 18 on its upper side and which has a side edge portion 27 extending lengthwise of the bed in a horizontal direction. The frame 17 also has, spaced laterally inwardly from the side edge 27, spaced and downwardly extending vertical posts 31. A horizontally extending side rail support member 32 is fixedly secured to the lower ends of the posts 31, and extends lengthwise of the bed substantially parallel to the side edge 27 of the mattress support portion 26. In the preferred embodiment, the side rail support member 32 is a metal tube of square cross section.

The side rail 22 includes six U-shaped brackets 36 provided at uniformly spaced locations along the underside of the side rail support member 32, and the bight of each bracket is fixedly secured to the support member 32 by welds 37. Extending between the parallel legs of each U-shaped bracket 36 is a respective pivot pin 38, which defines a pivot axis 39. Referring to FIG. 4, reference numeral 41 represents a horizontal reference plane which is approximately parallel to the patient support surface 19 on the mattress 18, and reference numeral 42 designates a vertical reference plane 42 which extends parallel to the side edge 27 of the support portion 26 of the frame. It will be recognized that the plane of the drawing of FIG. 4 represents a further vertical reference plane which is perpendicular to each of the planes 41 and 42. The pivot axes 39 for all of the brackets 36 are parallel to each other, each bracket 36 being welded to the support member 32 so that its pivot axis 39 extends at an acute angle to each of the three reference planes mentioned above. For purposes of explaining the present invention, the pivot axis 39 may be considered to be oriented at an acute angle of approximately 45° with respect to each of these three reference planes. However, the orientation of the pivot axis 39 may be different for other applications without departing from the essence of the present invention.

A plurality of elongate cylindrical support arms 46 each have an end cap 47 at one end, and a further end cap 48 at the opposite end. The end cap 47 and associated end of each arm 46 are disposed between the legs of a respective bracket 36, the pin 38 extending through aligned openings in the cap 47 and arm 46 so that the arm 46 and cap 47 are supported on the pin 38 for pivotal movement above the pivot axis 39. The end cap 48 at the opposite end of each arm 46 is disposed between the legs of a respective one of several further U-shaped brackets 51, each of which has a pivot pin 52 extending through an end of a respective arm 46 and the end cap 48 thereon so that the bracket 51 can pivot with respect to the arm 48 about a further pivot axis 53. The pivot axes 53 are all parallel to each other, and are also parallel to the pivot axes 39.

Each of the U-shaped brackets 51 has a bight which is welded, as at 56, to an elongate tubular metal top rail 57 which extends parallel to the side edge 27 of the portion 26 of the frame 17. Thus, the top rail 57 also extends parallel to the reference planes 41 and 42.

Figure 3:
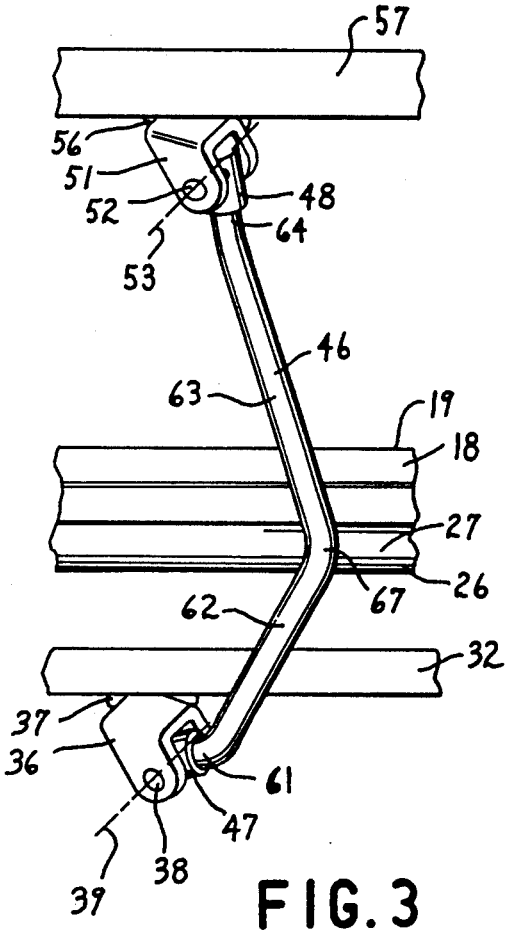
FIG. 3 is a fragmentary side view showing part of the bed and side rail of FIG. 1 in an enlarged scale.

Each of the arms 46 is bent to have four generally rectilinear portions 61–64. In the operational position of FIGS. 3 and 4, the portion 61, which is disposed partly in the end cap 47, extends radially outwardly from the pivot axis 39, the portion 62 extends upwardly and laterally outwardly from the radially outer end of the portion 61 at an acute angle thereto to a location spaced horizontally laterally outwardly from the side edge portion 27, the portion 63 extends upwardly and laterally inwardly from the upper end of portion 62 at an acute angle to portion 62 to a location above side edge portion 27, and the portion 64 extends away from the upper end of portion 63 at an acute angle thereto and into the end cap 48 in a direction radially of pivot axis 53. It will be recognized, however, that the shape of the arms 46 can be varied without departing from the present invention.

As shown by the broken line 66 in FIG. 4, the top rail 57 is disposed laterally outwardly of the rest of side rail 22, including the bend 67 between the portions 62 and 63 of arm 46. This ensures that, as the stretcher 10 is being wheeled through a hospital, a fixed object such as door frames will engage the top rail 57 rather than the arms 46, and thus will not be able to snag the arms 46. Instead, the fixed object will simply slide along the top rail 57 without impeding forward progress of the bed 10. The top rail 57 is further laterally outward than the rest of the side rail in all operational positions of the side rail.

Figure 2:
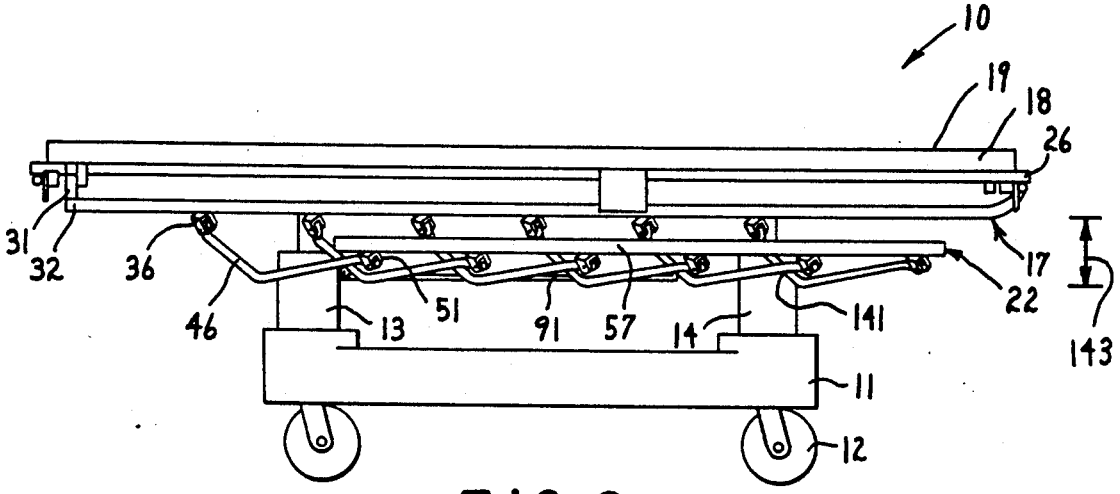
FIG. 2 is a side view similar to FIG. 1 but showing the side rail in a retracted position.

With reference to broken line 65 in FIG. 4, it will be noted that, in the operational position, part of the bracket 51 and the upper end of arm 46 are disposed vertically above the outer edge portion of the mattress support 26 of frame 17. Broken line 68 in FIG. 4 represents the path of movement of the center line of the side rail 57 as the side rail 22 moves from its operational position to its retracted position (FIG. 2). It will be noted that the top rail 57 and bracket 51 move laterally outwardly (leftwardly in FIG. 4) during the first half of downward movement toward the retracted position, until they reach the intermediate position shown in broken lines at 69, and then move laterally inwardly (rightwardly in FIG. 4) so that, in the retracted position represented by broken lines at 70, they are completely laterally inward of the line 65 and side edge 27. Each arm 46 is also completely laterally inward of the line 65 and side edge 27 in the retracted position, so that no portion of the side rail 22 projects laterally outwardly beyond the line 65 or side edge 27. Thus, the side rail of the preferred embodiment is a "zero clearance" side rail which allows the side edges 27 of two beds to be placed in direct engagement with each other (with no clearance therebetween) for purposes of transferring a patient from the mattress on one bed to the mattress on the other, without any interference from the side rail on either bed. It should also be noted, in the intermediate position represented by broken lines 69 in FIG. 4, the top rail 57 and bracket 51 are spaced outwardly a short distance from the side edge 27 so that fingers will not be pinched between edge 27 and the side rail.

Figure 7:
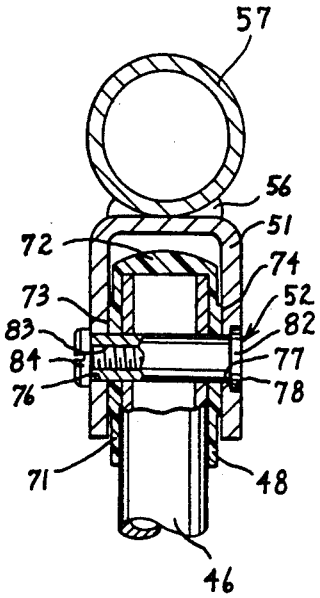
FIG. 7 is a sectional view taken along the line 7—7 in FIG. 6.
Figure 5:
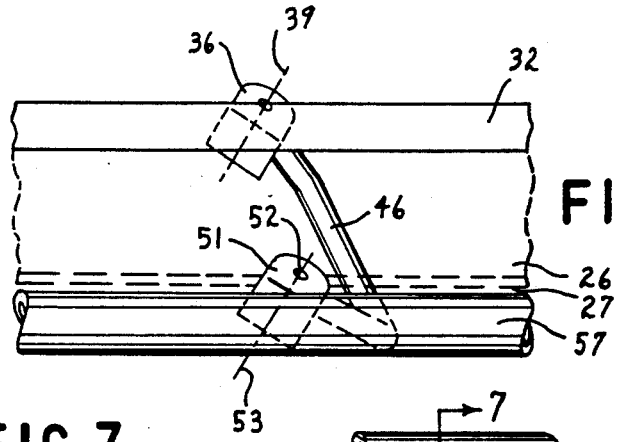
FIG. 5 is a fragmentary top view of the structure shown in FIGS. 3 and 4.

FIG. 7 is a sectional view which shows in more detail the manner in which each end of each of the support arms is pivotally supported in a respective U-shaped bracket. In FIG. 7, the end cap 48 includes a cylindrical sleeve portion 71 which has the end of arm 46 snugly received therein, and has an end wall 72 closing one end of the sleeve portion 71, the end of the arm 46 being disposed against the inner side of end wall 72. The sleeve portion 71 has on opposite sides thereof parallel outwardly facing flat side surfaces 73 and 74, which are each slidably disposed against a respective leg of the U-shaped bracket 51. The pivot pin 52 extends through aligned openings in the sleeve portion 71 and end of arm 46, and also through aligned openings 76 and 77 provided in the legs of the bracket 51. On the outer side of the bracket leg having hole 77 is a shallow circular recess 78 which is coaxial to the opening 77. The pivot pin 52 includes a body having a cylindrical shank 81 which extends through all of the aligned openings and which has at one end a head 82 received in the recess 78. The end of the shank 81 remote from the head 82 has an internally threaded axial opening 83, and a screw 84 has a threaded shank which engages the opening 83 and has a head which is disposed against the bracket leg containing opening 76.

Figure 6:
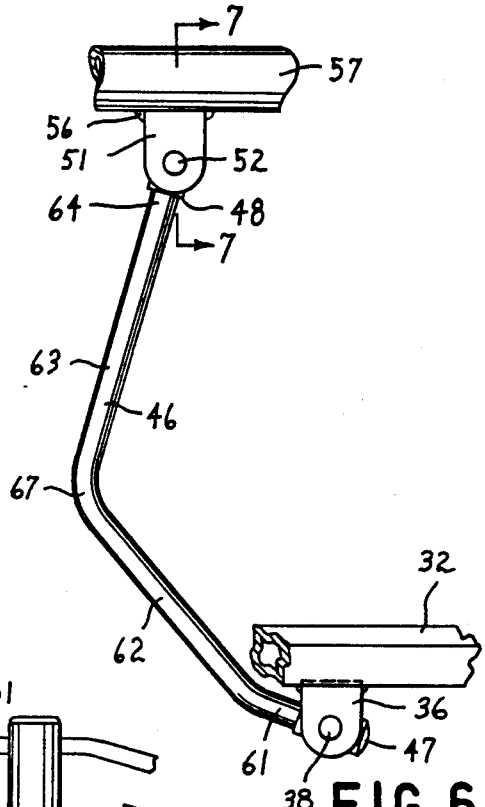
FIG. 6 is a fragmentary view of part of the side rail and bed, taken in a direction perpendicular to pivot axes of the side rail.

Referring to FIG. 6, which is a view in a direction perpendicular to the pivot axes, it will be noted that the top rail 57 and the support member 32 each extend at an acute angle with respect to the plane of the drawing.

Figure 8:
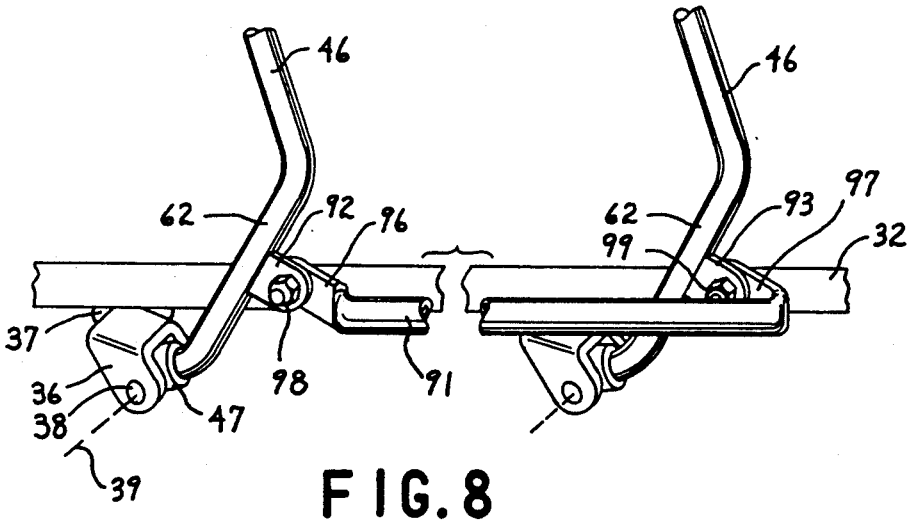
FIG. 8 is a fragmentary view of another part of the side rail of FIG. 1 which shows in an enlarged scale a link member which is a component of the side rail of FIG. 1.

Referring to FIG. 1, a link member 91 extends between and has its ends pivotally coupled to two of the arms 46, which in the preferred embodiment are the second and fourth of the six supports arms 46. The link member 91 and the two arms on which it is supported are shown in more detail in FIG. 8. Referring to FIG. 8, these two arms 46 each have welded to the middle of portion 62 thereof a respective platelike tab 92 or 93, the tabs 92 or 93 each extending perpendicular to the pivot axes 39. The link member 91 is an elongate metal tube having respective platelike tabs 96 and 97 welded to its ends, the tabs 96 and 97 also being perpendicular to the pivot axes 39 and also each being disposed against a respective one of the tabs 92 and 93. The tabs 92 and 96 are pivotally coupled by a bolt and nut 98 extending through aligned openings in the tabs parallel to the pivot axes 39, and the tabs 93 and 97 are pivotally coupled by a bolt and nut 99 extending through aligned openings in the tabs parallel to the pivot axes 39.

Figure 9:
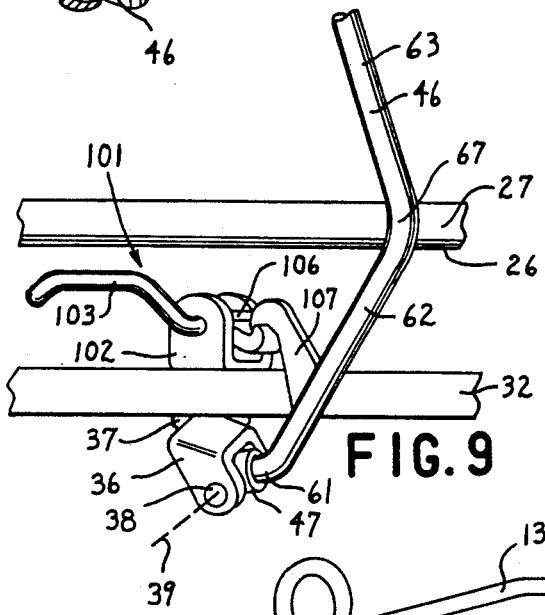
FIG. 9 is a fragmentary view of a portion of FIG. 1 which shows in an enlarged scale a latch mechanism for the side rail of FIG. 1.

In order to hold the side rail in the raised position shown in FIG. 1, a latch mechanism 101 is provided and cooperates with one of the arms 46 of the side rail. The latch mechanism 101 is shown in more detail in FIG. 9. With reference to FIG. 9, the latch mechanism 101 includes a U-shaped bracket 102 which is welded to an upper side of the support member 32 of the frame. A cranklike operating member 103 has a portion which extends between and is rotatably supported by the legs of the bracket 102. A hooklike latch member is secured to the operating member 103 between the legs of the bracket, and is yieldably urged in a counterclockwise direction in FIG. 9 by a not-illustrated spring disposed between the latch member 106 and the bight of the bracket 102. The latch mechanism 101 also includes a hooklike latch plate 107 which is welded to the portion 62 of the arm 46. In the preferred embodiment, the plate 107 is oriented to extend approximately perpendicular to the pivot axes 39. The pivot axis for the latch member 106 extends horizontally in FIGS. 9 and 10, but could alternatively be oriented to extend parallel to the axes 39 by appropriately reorienting the U-shaped bracket 102 welded to the support member 32.

Figure 10:
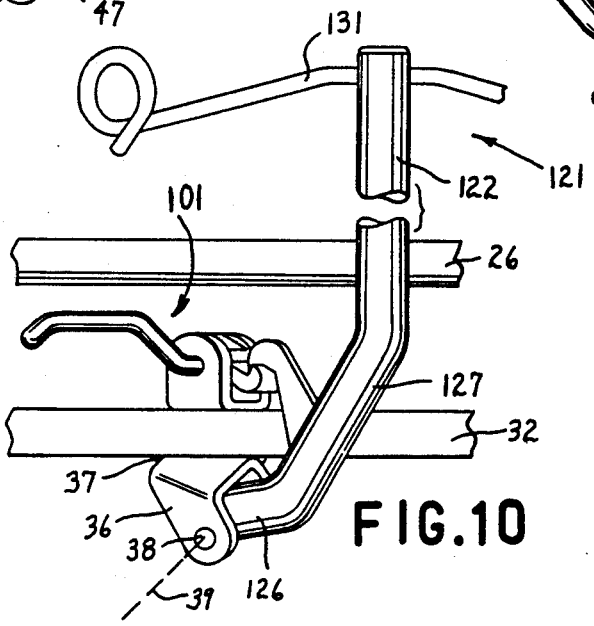
FIG. 10 is a fragmentary side view of an alternative embodiment, which includes an IV pole movably supported on a bed.

FIG. 10 shows an alternative mechanism which demonstrates that the present invention can be used for components on a bed other than a side rail, in this case an IV pole 121. Most of the structure shown in FIG. 10 is identical to corresponding structure in FIGS. 1–9, and identical parts have therefore been identified with identical reference numerals, and only the differences are described in detail. In particular, an IV pole 121 is pivotally supported by a single bracket 36 secured to the support member 32. On a more specific level, the bracket 36 pivotally supports a modified arm having two portions 126 and 127 which are equivalent to the portions 61 and 62 of the longer arm 46 in FIGS. 1–9. A pole part 122 of the IV pole 121 extends vertically upwardly from the end of arm section 127. In the preferred embodiment, the pole part 122 and arm sections 126 and 127 are respective portions of a single integral rod, but it will be recognized that the IV pole could be separate from and fixedly secured to the arm. A bent metal rod 131 extends through an opening at the upper end of and is fixedly secured to the pole part 122, and is bent at each end to define respective hooks which can each support IV equipment in a conventional manner. The IV pole 121 is releasably maintained in its upright position by the latch mechanism 101. In the retracted position, the pole part 122 extends generally horizontally, and the end nearest hook 131 rests on top of and is supported by a not-illustrated stop or support provided on the frame 17.

It will be recognized that the arrangement shown in FIG. 10 can also be used to support other components on the bed, such as a stirrup for the foot of a patient, a support for the leg of a patient, a hand grip for a patient, or a push handle which can be used to move the bed.

OPERATION

In order to move the side rail 22 from the raised position of FIG. 1 to the retracted position of FIG. 2, an operator manually lifts the outer end of operating member 103 (FIG. 9) so as to pivot the portion supporting latch member 106, latch member 106 pivoting downwardly against the urging of the not-illustrated spring and thus interrupting engagement between the latch member 106 and the latch plate 107. Then, while holding the top rail 57 with the other hand, the operator manually lowers the side rail 22 from the raised position shown in FIG. 1 to the retracted position shown in FIG. 2. The top rail 57 and bracket 51 will automatically follow the curved path indicated by the broken line 68 in FIG. 4, pursuant to which they initially move downwardly and laterally outwardly to the position shown in broken lines at 69 in FIG. 4, and then move downwardly and laterally inwardly to a point below the portion 26 of the frame and disposed entirely laterally inwardly of the line 65 representing the outer side edge 27 of the frame, as shown by broken lines at 70. During this downward movement of the top rail 57, the hand of the operator will have a natural tendency to rotate a small amount on the top rail 57, and the top rail 57 is thus preferably cylindrical as shown in FIG. 4 so that the hand of the operator can rotate without discomfort.

In the retracted position, adjacent arms 46 engage each other, for example as shown at 141 in FIG. 2, thereby preventing pivotal movement of the side rail beyond the retracted position shown in FIG. 2. It will be recognized that stops could alternatively be provided on the frame in order to engage the side rail as it reaches the retracted position and then support the side rail in the retracted position. The link member 91 can be omitted from the side rail 22, but there will tend to be a small amount of wobble in the top rail 57 when the side rail is at or near the retracted position of FIG. 2. The link member 91 is effective in substantially eliminating this wobble, and it is thus preferred that the link member 91 be present.

In order to raise the side rail from its retracted position of FIG. 2 to its raised position of FIG. 1, the operator simply grasps the top rail 57 and lifts the top rail 57 upwardly. The side rail 22 will move in a manner directly opposite that by which it moved from the raised to the retracted position, including upward movement of the top rail 57 and bracket 51 along the path designated by broken line 68 in FIG. 4. As the side rail reaches its raised position, the latch plate 107 on one of the arms 46 will engage the latch member 49 of the locking mechanism 101 and pivot the latch member 106 downwardly against the urging of the not-illustrated spring until the hook end of plate 107 passes the hook end of latch member 106, at which point the spring will pivot the latch member 106 upwardly so that the hook portions engage in the manner shown in FIG. 9, and thus prevent the side rail 22 from moving away from its raised position.

Referring to FIG. 2, it will be noted that, in the retracted position, the elongate components of the side rail are oriented so that they are vertically close to each other and so that the longest components extend approximately horizontally. Consequently, and as evident from FIG. 2, the collapsed side rail has a minimal vertical height, as indicated at 143 in FIG. 2. This permits the bed 10 to be used with X-ray units or C-arm fluoroscopes, where respective structural parts must simultaneously be disposed above and below the frame 17 and the mattress 18. Since the side rail 22 has a minimal vertical height, a bed having the side rail 22 can be used with equipment of this type without interference from the side rail. Also, since the side rail retracts laterally under the mattress, such equipment can be moved up close to the mattress without engaging the side rail.

Also, and as mentioned above, the fact that the side rail is, in its retracted position, disposed entirely inwardly of the line 65 (FIG. 4) corresponding to the side edge 27 means that two beds can be placed adjacent each other with the side edges 27 in direct contact, in order to permit a patient to be transferred from the mattress 18 on one bed to the mattress 18 on the other, without having the side rail on either bed engage structure on the other bed in a manner preventing the side edges 27 from being placed closely adjacent each other.

Operational use of the IV pole 121 shown in FIG. 10 is sufficiently similar to operation of the side rail 22 that a detailed discussion is believed unnecessary. It is only necessary to mention that, in the preferred embodiment, the pole part 122 of the IV pole 121 extends approximately horizontally when the IV pole 121 is in its retracted position disposed inwardly of the side edge of the frame, and thus the IV pole 121 also has a minimal vertical height in its retracted position.

Although two embodiments of the invention have been described in detail for illustrative purposes, it will be recognized that there are modifications and variations of these embodiments, including the rearrangement of parts, which lie within the scope of the present invention.

The embodiments of the invention in which an exclusive property or privilege is claimed are defined as follows:

1. An apparatus comprising: a patient support having an upwardly facing patient support surface and having an approximately horizontally extending edge portion, an arm having first and second ends, means cooperable with said first end of said arm for supporting said arm for pivotal movement with respect to said edge portion about a pivot axis oriented at an acute angle to a horizontal reference plane, said second end of said arm being spaced radially from said pivot axis, and a member supported on said arm at said second end thereof, said arm being pivotal between operational and retracted positions in which said member is respectively higher than and lower than said patient support surface; wherein said pivot axis forms an acute angle with respect to a vertical reference plane extending perpendicular to said edge portion; and wherein said pivot axis forms an acute angle with respect to a further reference plane which is perpendicular to each of said horizontal and vertical reference planes.

2. An apparatus according to claim 1, wherein as said arm moves to said retracted position thereof, said member on said arm moves downwardly and inwardly from a position spaced horizontally outwardly relative to said edge portion to a position disposed below said edge portion.

3. An apparatus according to claim 2, wherein when said arm is in said retracted position, said arm and said member are both disposed lower than and completely laterally inwardly of said edge portion.

4. An apparatus according to claim 2, wherein as said arm moves from said retracted position to said operational position, said member thereon moves from said position disposed below said edge portion to said position spaced horizontally outwardly from said edge portion, and then moves upwardly and laterally inwardly from said position spaced outwardly from said edge portion to a position in which at least a portion thereof is disposed above said edge portion.

5. An apparatus according to claim 4, wherein when said arm is in said operational position, said arm has a first portion which extends approximately radially outwardly from said pivot axis, and a second portion which extends upwardly and laterally outwardly from the radially outer end of said first portion to a location spaced horizontally outwardly from said edge portion.

6. An apparatus comprising: a patient support having an upwardly facing patient support surface and having an approximately horizontally extending edge portion, an arm having first and second ends, means cooperable with said first end of said arm for supporting said arm for pivotal movement with respect to said edge portion about a pivot axis oriented at an acute angle to a horizontal reference plane, said second end of said arm being spaced radially from said pivot axis, a member supported on said arm at said second end thereof, said arm being pivotal between operational and retracted positions in which said member is respectively higher than and lower than said patient support surface; a further arm having a first end supported for pivotal movement between operational and retracted positions about a second pivot axis which is parallel to said first-mentioned pivot axis, and having a second end, said member being elongate and said second ends of said arms being pivotally coupled to said member at spaced locations thereon for pivotal movement about third and fourth pivot axes which are each parallel to said first-mentioned and second pivot axes.

7. An apparatus according to claim 6, wherein as said arms move away from said retracted position said elongate member moves upwardly and laterally outwardly with respect to said edge portion.

8. An apparatus according to claim 7, wherein said elongate member extends substantially horizontally in all operational positions thereof, and wherein in said retracted position said arms extend generally horizontally in close proximity to said elongate member, whereby in said retracted position said arms and said elongate member have a compact vertical height.

9. An apparatus according to claim 7, wherein when said arms are in said retracted position, said arms and said elongate member are all disposed lower than and completely laterally inwardly of said edge portion.

10. An apparatus according to claim 7, wherein as said arms move from said retracted position to said operational position, said elongate member moves upwardly and laterally outwardly from said position below said edge portion to said position spaced horizontally laterally outwardly from said edge portion, and thereafter moves upwardly and inwardly to a position in which at least a portion thereof is disposed above said edge portion.

11. An apparatus according to claim 10, wherein when said arms are in said operational position, each said arm has a first portion which extends approximately radially outwardly from said pivot axis, a second portion which extends upwardly and laterally outwardly from a radially outer end of said first portion to a location spaced horizontally outwardly from said edge portion, and a third portion which extends upwardly and laterally inwardly from an upper end of said second portion.

12. An apparatus according to claim 11, wherein each said arm includes a fourth portion which, when said arms are in said operational position, extends upwardly and laterally outwardly from an upper end of said third portion in a direction approximately radially of the pivot axis about which the arm is pivotally coupled to said elongate member.

13. An apparatus according to claim 10, wherein said elongate member has a portion which extends lengthwise thereof and which, in all operational positions of said arms, is disposed laterally outwardly of all portions of each of said arms.

14. An apparatus according to claim 6, wherein said elongate member is substantially cylindrical.

15. An apparatus according to claim 6, including a stationary support member which has a surface extending parallel to said edge portion and which is disposed lower than and laterally inwardly of said edge portion, including two U-shaped first brackets each having a bight fixedly secured to said surface of said support member at spaced locations therealong and having two spaced legs, and two U-shaped second brackets each having a bight fixedly secured to said elongate member at spaced locations therealong and having two spaced legs, said first end of each said arm being disposed between and pivotally supported on the legs of a respective said first bracket and said second end of each said arm being disposed between and pivotally supported on the legs of a respective said second bracket.

16. An apparatus according to claim 6, including latch means for releasably holding one of said arms in said operational position thereof.

17. An apparatus according to claim 6, including an elongate link member extending approximately parallel to said edge portion and having two ends which are each coupled to a respective one of said arms at a location between the first and second ends of the arm for pivotal movement about a respective pivot axis which is parallel to each of said first-mentioned, second, third and fourth pivot axes.

18. An apparatus according to claim 17, wherein each said arm coupled to said link member has a plate-like tab which is fixedly secured thereto at a location between said ends thereof and which extends substantially perpendicular to each of said pivot axes, wherein said link member has fixedly secured to each end thereof a respective platelike tab which extends parallel to and is disposed against a respective one of said tabs on said arms, and including an opening through each said tab on said link member which is aligned with an opening through the associated tab on a respective said arm, and including two bolts which each extend through a respective set of said aligned openings and each have a nut thereon.

19. An apparatus according to claim 6, wherein said pivot axes each form an acute angle with respect to a vertical reference plane extending perpendicular to said edge portion, and wherein said pivot axes each form an acute angle with respect to a further reference plane which is perpendicular to each of said horizontal and vertical reference planes.

20. A hospital bed, comprising: means defining a stationary frame, means defining an upwardly facing patient support surface, and a side rail supported on said frame for movement between raised and retracted positions, said side rail including a top rail and a plurality of arms which each have a first end supported on said frame for pivotal movement about a respective first axis and have a second end supported on said top rail for pivotal movement about a respective second axis, said first and second axes all being parallel to each other, and each of said first and second axes extending at an acute angle with respect to a horizontal reference plane.

21. An apparatus according to claim 20, wherein each of said first and second pivot axes extend at an acute angle with respect to a vertical reference plane which extends substantially parallel to said top rail, and extend at an acute angle with respect to a second vertical reference plane perpendicular to said first vertical reference plane.

22. A hospital bed, comprising: means defining a stationary frame, means defining an upwardly facing patient support surface, and a side rail supported on said frame for movement between operational and retracted positions, said side rail including an elongate top rail and a plurality of arms which each have a first end supported on said frame for pivotal movement about a respective first pivot axis and a second end supported on said top rail for pivotal movement about a respective second pivot axis, said first and second pivot axes all being parallel to each other, and wherein said top rail extends at an acute angle with respect to a reference plane which is perpendicular to said first and second pivot axes.

23. An apparatus comprising: a patient support having an upwardly facing patient support surface and having an approximately horizontally extending edge portion, an arm having first and second ends, means cooperable with said first end of said arm for supporting said arm for pivotal movement with respect to said edge portion about a pivot axis oriented at an acute angle to a horizontal reference plane and at an angle to a vertical reference plane extending perpendicular to said edge portion, said second end of said arm being spaced radially from said pivot axis, and a member supported on said arm at said second end thereof, wherein said pivot axis forms an acute angle with respect to said vertical reference plane and extends at an acute angle with respect to a further reference plane which is perpendicular to each of said horizontal and vertical reference planes.

24. The apparatus of claim 23, wherein said member supported on said arm is an IV pole, said arm being movable between operational and retracted positions in which said IV pole respectively extends substantially vertically and substantially horizontally.

25. An apparatus according to claim 24, wherein when said arm is in said operational position, said TV pole extends upwardly from a location spaced horizontally outwardly from said edge portion, and wherein when said arm is in said retracted position, said IV pole and said arm are disposed lower than and completely laterally inwardly of said edge portion.

* * * * *

UNITED STATES PATENT AND TRADEMARK OFFICE

CERTIFICATE OF CORRECTION

PATENT NO. : 5 187 824

DATED : February 23, 1993

INVENTOR(S) : Martin W. STRYKER

It is certified that error appears in the above-identified patent and that said Letters Patent is hereby corrected as shown below:

Column 9, line 64; change "said position" to ---a position---.

Column 12, line 27; change "TV" to ---IV---.

Signed and Sealed this

Fourteenth Day of December, 1993

Bruce Lehman

*Attest:*

BRUCE LEHMAN

*Attesting Officer*

*Commissioner of Patents and Trademarks*